US006831226B2

(12) United States Patent
Allen, Jr.

(10) Patent No.: US 6,831,226 B2
(45) **Date of Patent: *Dec. 14, 2004**

(54) DEVICE FOR PROVIDING ACCESS TO ELECTRICAL CONNECTIONS TO ENCLOSURE

(76) Inventor: Philip Brown Allen, Jr., 6485 Eagle Ridge Rd., Bettendorf, IA (US) 52722

( * ) Notice: Subject to any disclaimer, the term of this patent is extended or adjusted under 35 U.S.C. 154(b) by 0 days.

This patent is subject to a terminal disclaimer.

(21) Appl. No.: 10/788,104

(22) Filed: Feb. 26, 2004

(65) Prior Publication Data

US 2004/0166729 A1 Aug. 26, 2004

Related U.S. Application Data

(63) Continuation of application No. 10/340,228, filed on Jan. 10, 2003, now Pat. No. 6,700,062.

(51) Int. Cl.[7] ..... H01H 13/04

(52) U.S. Cl. ..... 174/53; 174/58; 439/107; 200/43.18

(58) Field of Search ..... 174/53, 58; 439/107, 439/148, 142; 200/43.18

(56) References Cited

U.S. PATENT DOCUMENTS 3,959,790 A * 5/1976 Schuyler ..... 340/568.3
5,161,240 A * 11/1992 Johnson ..... 361/42
5,190,481 A 3/1993 Ju
5,340,326 A 8/1994 LeMaster
5,586,002 A * 12/1996 Notarianni ..... 361/681
5,621,788 A * 4/1997 Eiken ..... 379/147
5,967,836 A * 10/1999 Bailey ..... 439/534
6,087,780 A 7/2000 Benny
6,204,447 B1 3/2001 Gretz
6,268,987 B1 7/2001 Sundermann
6,437,700 B1 8/2002 Herzfeld et al.
6,492,591 B1 * 12/2002 Metcalf ..... 174/53

FOREIGN PATENT DOCUMENTS

DE GM 77 12 336.5 7/1977

* cited by examiner

*Primary Examiner*—Dhiru R. Patel
(74) *Attorney, Agent, or Firm*—McKee, Voorhees & Sease, P.L.C.

(57) ABSTRACT

A device for providing access to at least one power connection within an enclosure is disclosed. The device includes an assembly adapted for mounting to the enclosure and having an inside face and an outside face opposite the inside face for being inside the enclosure, the outside face for being outside the enclosure, an inside power outlet for receiving an electrical plug mounted to the inside face accessible from inside the enclosure, an outside power outlet for receiving an electrical plug mounted to the outside face and accessible from outside the enclosure, a cover operatively connected to the assembly having a first position for protecting the outside power outlet and a second position for providing access to the outside power outlet.

15 Claims, 9 Drawing Sheets

DEVICE FOR PROVIDING ACCESS TO ELECTRICAL CONNECTIONS TO ENCLOSURE

CROSS REFERENCE TO RELATED APPLICATIONS

This application is a continuation of U.S. patent application Ser. No. 10/340,228 filed on Jan. 10, 2003 now U.S. Pat. No. 6,700,062, the contents of which are hereby incorporated by reference in their entirety.

BACKGROUND OF THE INVENTION

The present invention relates to products that are often known as convenience interfaces or panel interfaces. A convenience interface provides a convenient method for personnel to access devices that reside inside an enclosure with out opening the enclosure door. These devices can include: (1) control devices with data ports, (2) network access ports, and (3) human interface ports such as for a computer mouse or keyboard, (4) various I/O devices, (5) data storage devices, and (6) programmable devices. The convenience interface sometimes contain various types of electrical power outlets so that personnel can also power their programming device from the same location as the convenience interface. Various equipment, machines, or facilities have control panels that contain one or more of the types of devices described above. Installing a convenience interface with a power outlet and an interface for all the applicable devices inside the control panel allows personnel to perform maintenance without opening the panel door thereby reducing their exposure to the hazardous voltage inside the enclosure. Various control panels are built with a separate power outlet mounted on the inside of the enclosure to provide power for the personnel working inside the panel, the separate power outlet being independent of the convenience interface.

The separate power outlet mounted on the inside of the enclosure may include a Ground Fault Circuit Interrupter (GFCI). GFCI's are required to be used on various types of control panels. GFCI's need to be tested monthly and reset if tripped. Devices that only provide access to the GFCI on the inside of the panel are inconvenient in that the enclosure must be regularly opened for test and reset operations, thus potentially exposing users to hazardous voltages.

Prior art devices are also known to include incoming power screw terminals on the inside of the panel and screw terminals for use as load terminals.

Therefore, although various types of convenience interfaces are known in the art, and these interfaces provide different levels of convenience and safety, problems remain.

Therefore, it is a primary object, feature or advantage of the present invention to improve over the state of the art.

Another object, feature, or advantage of the present invention is to provide a device for use with an enclosure that provides an electrical outlet on the inside of the enclosure for added convenience and safety.

Yet another object, feature, or advantage of the present invention is to provide a device for use with an enclosure that can include an interface connection on the outside of the enclosure.

A further object, feature, or advantage of the present invention is to provide a device for use with an enclosure that includes a ground fault circuit interrupter circuit.

Yet another object, feature, or advantage of the present invention is to provide a device for use with an enclosure that meets applicable regulatory requirements.

It is a further object, feature or advantage of the present invention to provide a device for use with an enclosure that provides for convenient interface to electrical equipment within the enclosure.

These, and/or other objects, features or advantages of the present invention become apparent from the specification and claims that follow.

SUMMARY OF THE INVENTION

The present invention includes a device for providing access to at least one power connection within an enclosure. The present invention includes a convenience interface with an electrical outlet on the outside of an enclosure as well as an electrical on the inside of the enclosure. The device includes an assembly adapted for mounting to the enclosure and having an inside face and an outside face opposite the inside face. The inside face is disposed within the enclosure. The outside face is on the exterior of the enclosure. The device includes a first power outlet for receiving an electrical plug mounted to the inside face and accessible from inside the enclosure. The device also includes a second power outlet for receiving an electrical plug mounted to the outside face and accessible from the outside of the enclosure.

In one embodiment, the device includes a cover operatively connected to the assembly having a first position for protecting the outside power outlet and a second position for providing access to the outside power outlet. The present invention provides the advantage of having the power outlet for receiving an electrical plug inside the enclosure. A power outlet is also located outside the enclosure. The assembly can be of various sizes, but is preferably a standard DIN rectangular connector housing. The assembly can be panel mounted without a cover or housing. Alternatively, the device can be used in conjunction with a cover and/or external housing. Also, preferably, the device includes a ground fault circuit interrupter for providing additional protection.

DETAILED DESCRIPTION OF THE PREFERRED EMBODIMENT

Figure 1:
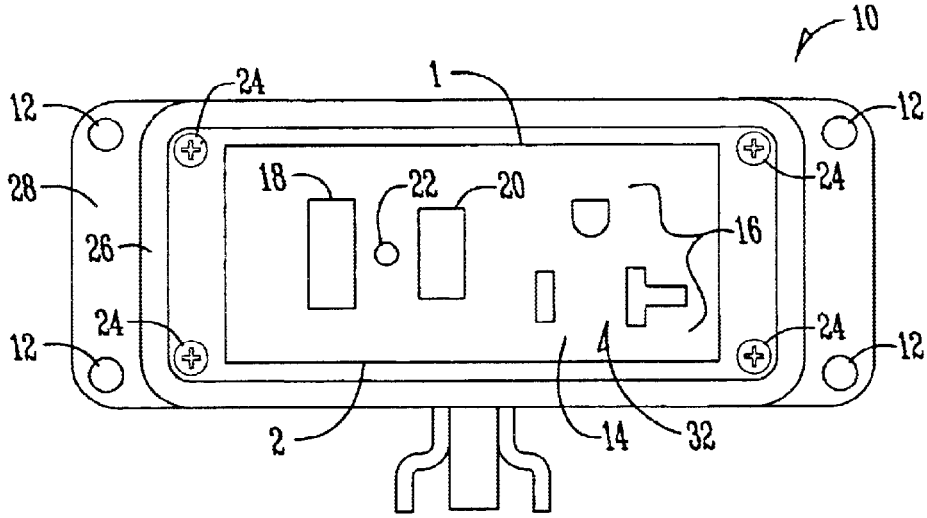
FIG. 1 is a front view of the outside face of a device according to one embodiment of the present invention.

The invention includes a device for providing access to power connections outside of an enclosure, such as on a control panel of a cabinet. FIG. 1 shows a front view of one embodiment of a device 10. The device 10 includes apertures 12 for mounting to the enclosure. The device 10 has an outside face 14 opposite an inside face. The outside face 14 is accessibly exposed on the outside of the enclosure. At least one power outlet 16 is also accessibly exposed on the outside face 14 of the device 10. The outside power outlet 16 is preferably adapted for receiving an electrical plug. The outside power outlet 16 can be a NEMA 5-15R. Alternatively, the power outlet can be a NEMA 5-20R outlet. The device 10 includes a top 1, a bottom 2, a first side 3 and an opposite second side 4.

Also on the outside face 14 is an optional reset button 18 and test button 20. The reset button 18 and test button 20 are used in conjunction with a ground fault connection interrupt outlet that provides additional protection. Placing the reset button on the outside face 14 allows for resetting a tripped GFCI without accessing the inside of the enclosure. An indicator such as an LED 22 is also placed on the outside face 14 to be used in connection with the test button 20. A plurality of connectors such as screws 24 are also shown for mounting the block or assembly 32 containing the connectors to the rest of the device. Where screws 24 are used, preferably the screws are finger safe. The device can include sidewalls 26 and mounting flange 28.

Figure 2:
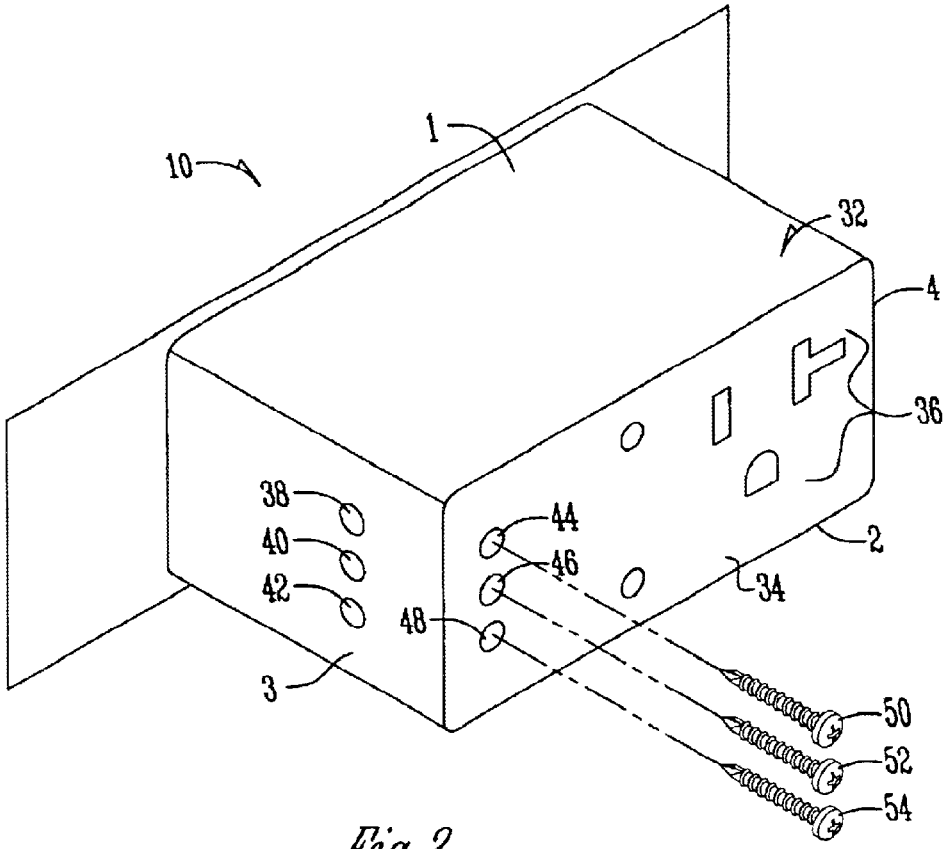
FIG. 2 is a perspective view of the inside face of the device of FIG. 1.

FIG. 2 shows a perspective view of the device 10 showing the block 32 with the inside face 34. The inside face 34 has an inside power outlet 36. The power outlet 36 is for receiving electrical plug. The inside power outlet 36 is accessible from inside of the enclosure. An inside power outlet 36 is used instead of mirror wired terminals. A plurality of apertures 38, 40, and 42 are shown for power line connections. Each power line connection is secured with a finger safe screw 50, 52, 54 that are inserted into apertures 44, 46, and 48, respectively. The inside power outlet is preferably a standard outlet such as a Nema 5-15R or Nema 5-20R. The present invention, however, is not limited to any particular type of power outlet and contemplates that various types may be used, as may be standard in a particular country, or otherwise desirable to use.

Figure 3:
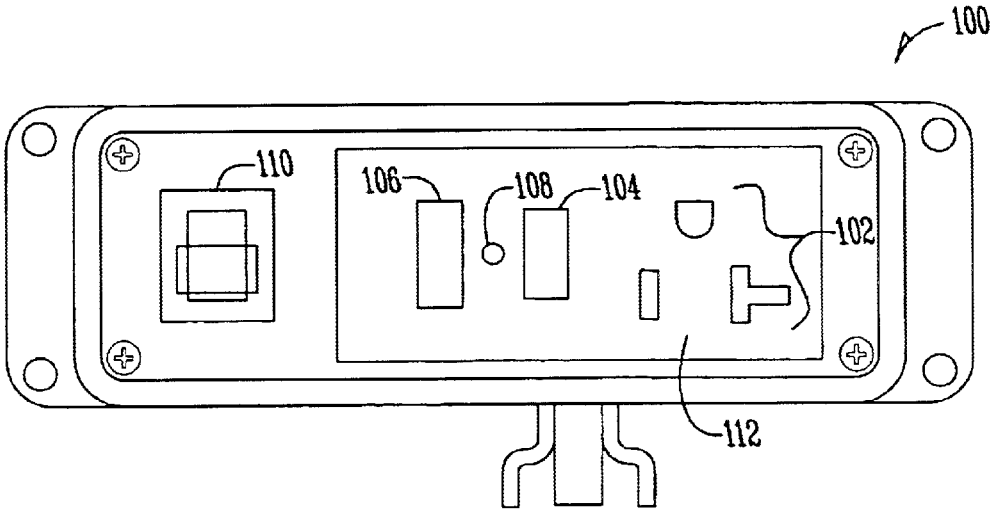
FIGS. 3 through 5 are front views of the outside face of a device according to various embodiments.

FIG. 3 shows another embodiment of the present invention. In FIG. 3, a front view is shown of an outside face 112 of a device 100. The device 100 includes an electrical outlet 102, test button 104, reset button 106, and indicator 108. In addition, a data interface connector 110 is shown. This allows data connections as well as power connections to be made from outside of an enclosure to inside of the enclosure without requiring removal of a door or control panel associated with the enclosure.

Figure 4:
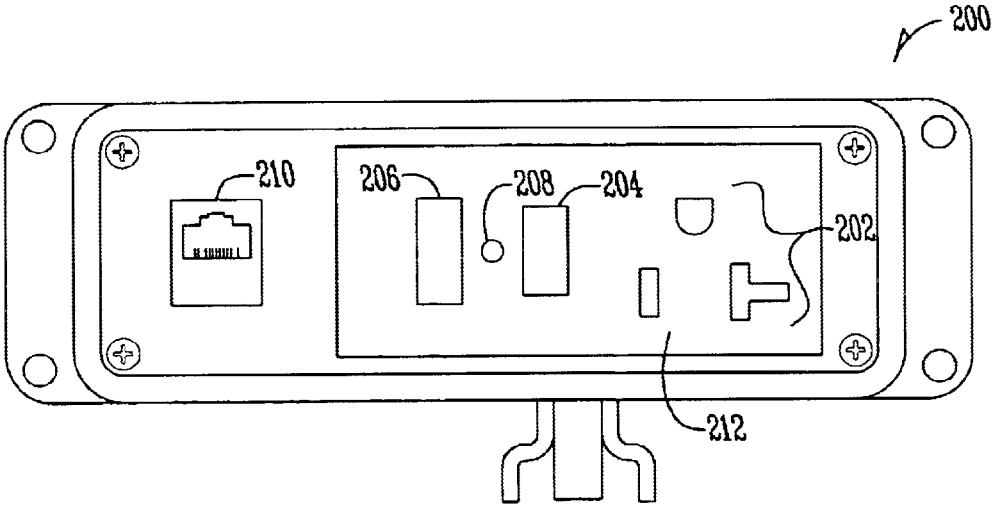

FIG. 4 shows another embodiment of a device according to the present invention. In FIG. 4, the device 200 has an electrical outlet 202, a test button 204, a reset button 206, an indicator 208, and a internet CAT5 bulkhead connector 210 (such as an RJ-45 connector) all located on an outside face 212.

Figure 5:
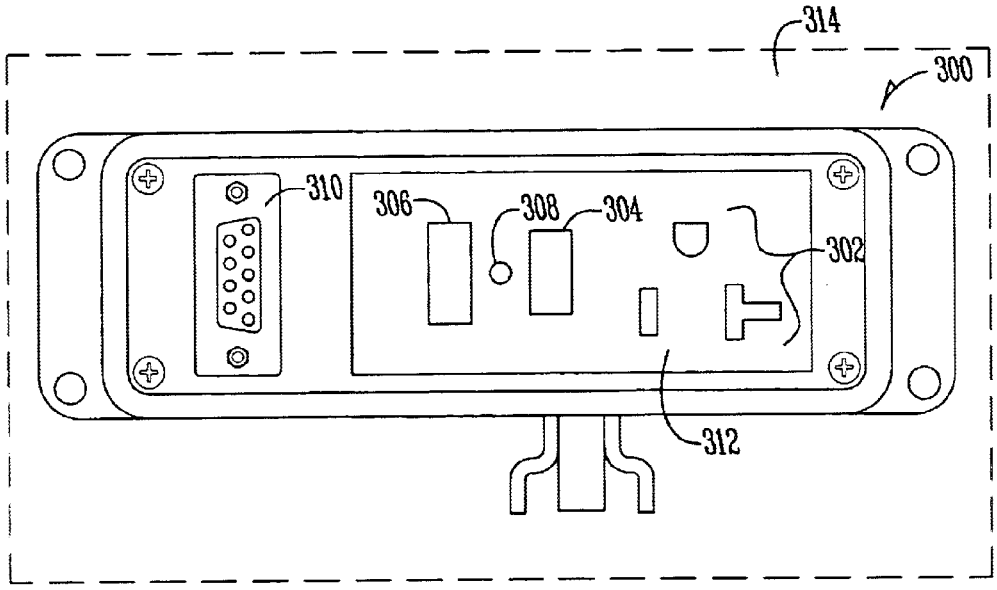
Figure 6:
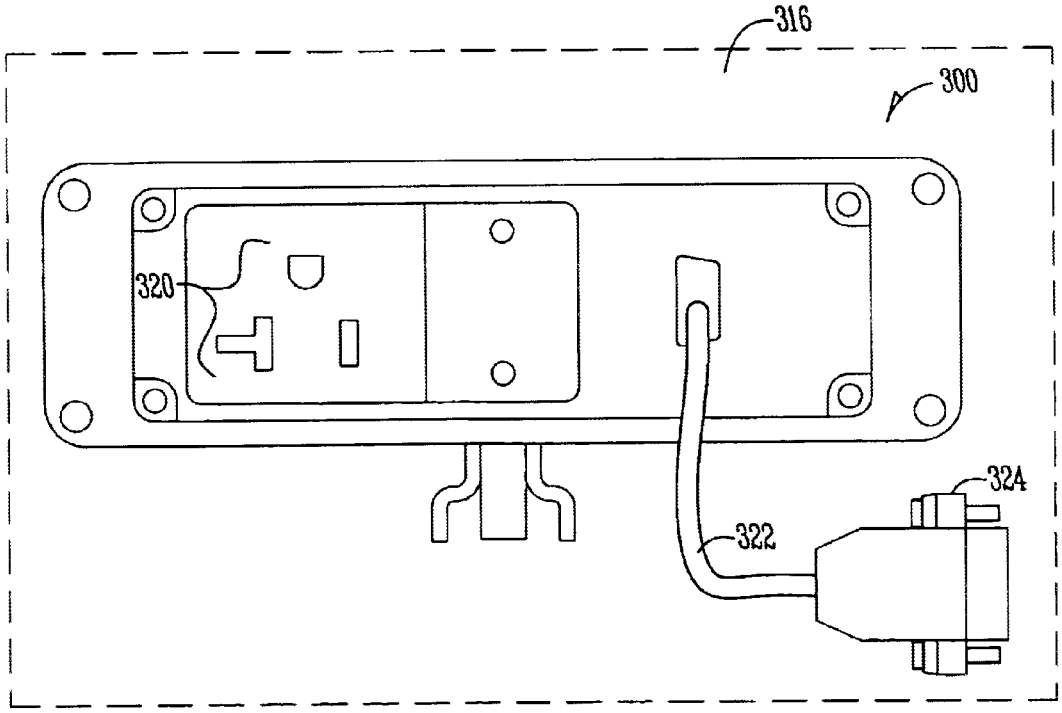
FIG. 6 is a rearview showing the inside face of a device according to the embodiment of FIG. 5.

FIGS. 5 and 6 show an outside face and an inside face, respectively, of an embodiment having a DB-9 serial connection. The device 300 is mounted to an enclosure 314. The device 300 has an outside face 312. Mounted to the outside face are an electrical outlet 302, a test button 304, a reset button 306, an indicator 308, and a DB-9 connector 310. The DB-9 connector can be used for RS-232 serial connections.

In FIG. 6, the inside wall 316 of an enclosure is shown. The device 300 has an inside electrical outlet 320. In addition, the device 300 has a cable 322 that extends from the DB-9 connector 310 on the outside of the enclosure to a second DB-9 connector 324 on the inside of the enclosure.

Figure 7:
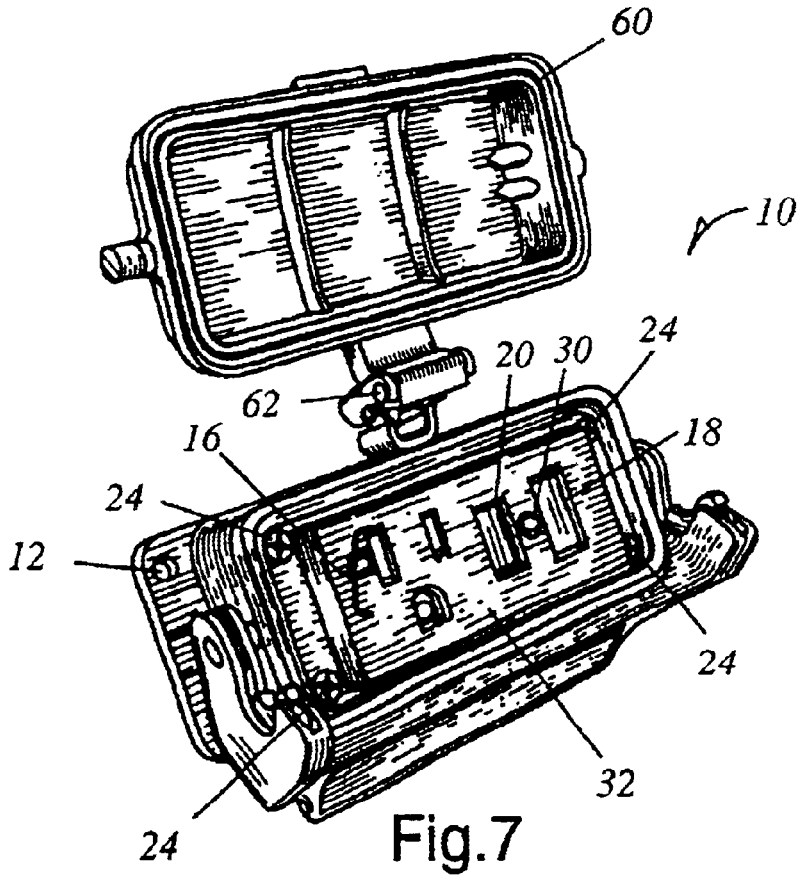
FIG. 7 is a perspective view showing one embodiment of a device according to the present invention having a cover in an open position.
Figure 8:
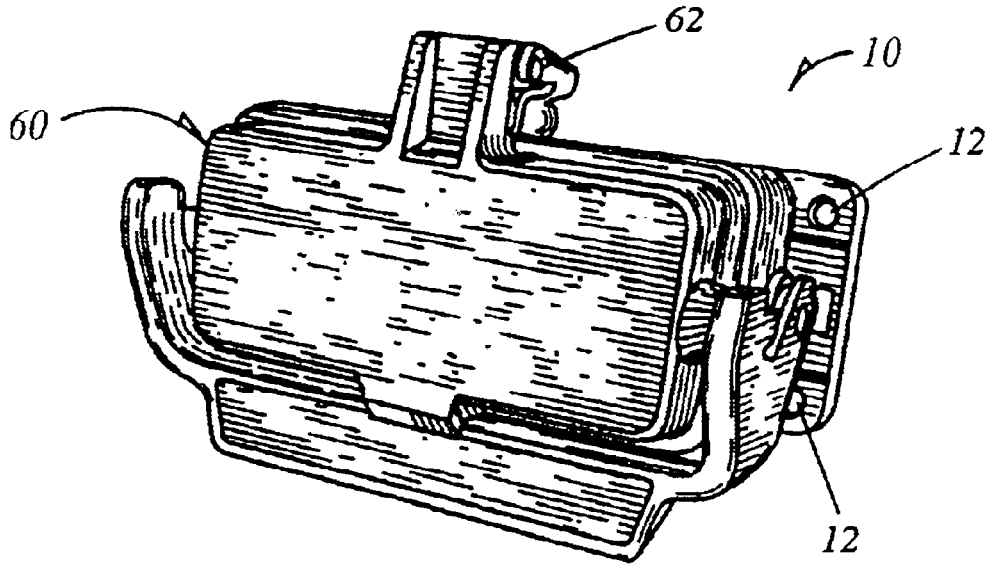
FIG. 8 is a perspective view showing the device of FIG. 7 with the cover in a closed position.

FIGS. 7 and 8 show a perspective view of one embodiment of the present invention. In FIG. 7, a cover 60 of the device 10 is shown in an open position. The cover 60 is operatively connected via a hinge 62 to extend between an open position and a closed position. FIG. 7 illustrates the open position while FIG. 8 represents the closed position of the cover 60.

Figure 9:
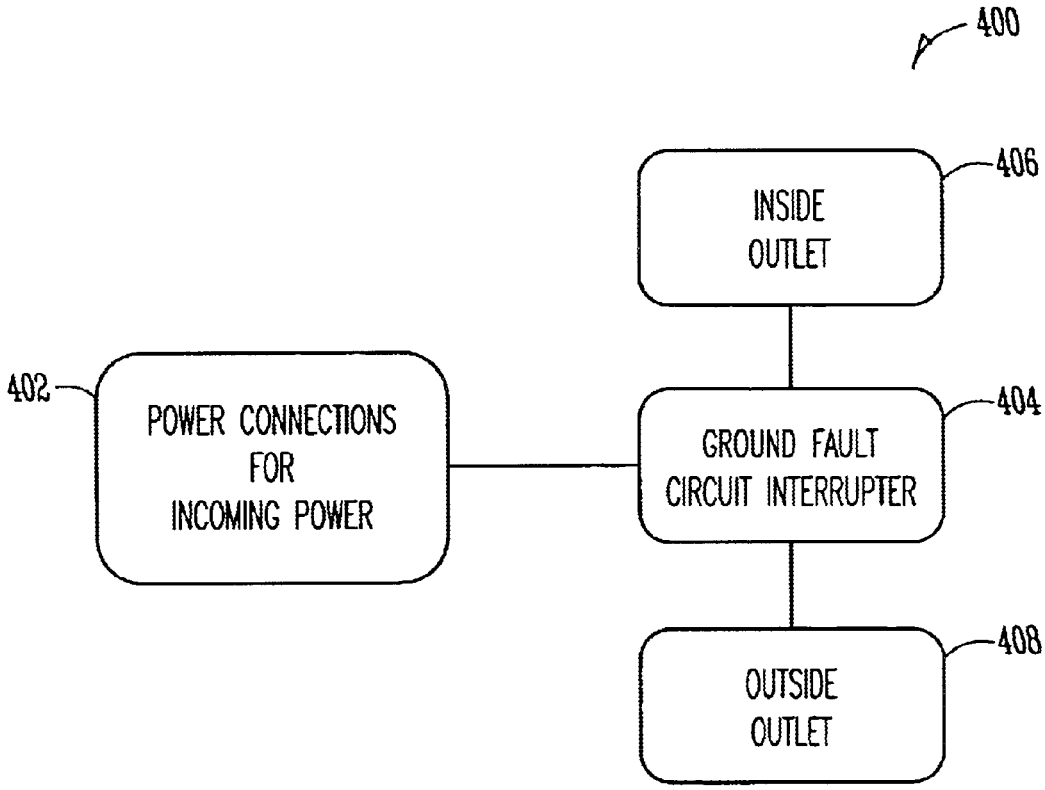
FIG. 9 is a block diagram showing the electrical connections according to one embodiment of the present invention.

FIG. 9 shows a block diagram showing the electrical connections. The electrical connections for device 400 include power connections 402 that are electrically connected to the ground fault circuit interrupter 404. The ground fault circuit interrupter 404 is also electrically connected to an inside connection 406 that is preferably an outlet as well as an outside connection 408 which is also preferably an outlet. Providing an inside outlet provides advantages of improved safety and convenience.

Preferably the assembly 32 of each device is sized to fit within a standard 16 or 24 position Deutsches Institut fur Normung (DIN) rectangular housing. For example where no data interface is used, a standard 16 position DIN rectangular housing can be used. Where a data interface is used, a 24 position DIN rectangular housing can be used.

Figure 10:
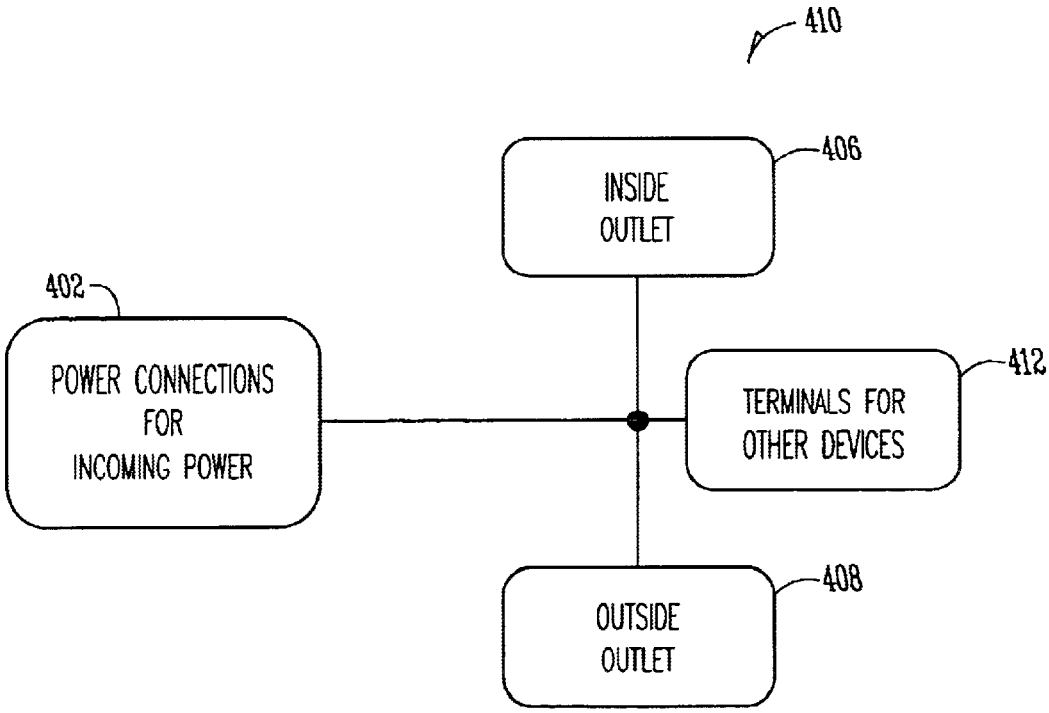
FIG. 10 is a block diagram of the electrical connections according to one embodiment of the present invention without a GFCI.

FIG. 10 shows a block diagram of one embodiment of the present invention without a GFCI. The assembly 410 includes power connections for incoming power 402 that are preferably finger safe screw terminals, but can be other types of connections for power. In addition, there is an inside outlet 406 which can be a Nema 5-15A, Nema 5-20R, Nema 5-15R, or other type of outlet, whether United States or International. An outside outlet 408 is also provided. In addition, terminals 412 for other types of devices can also be provided within the assembly.

Figure 11:
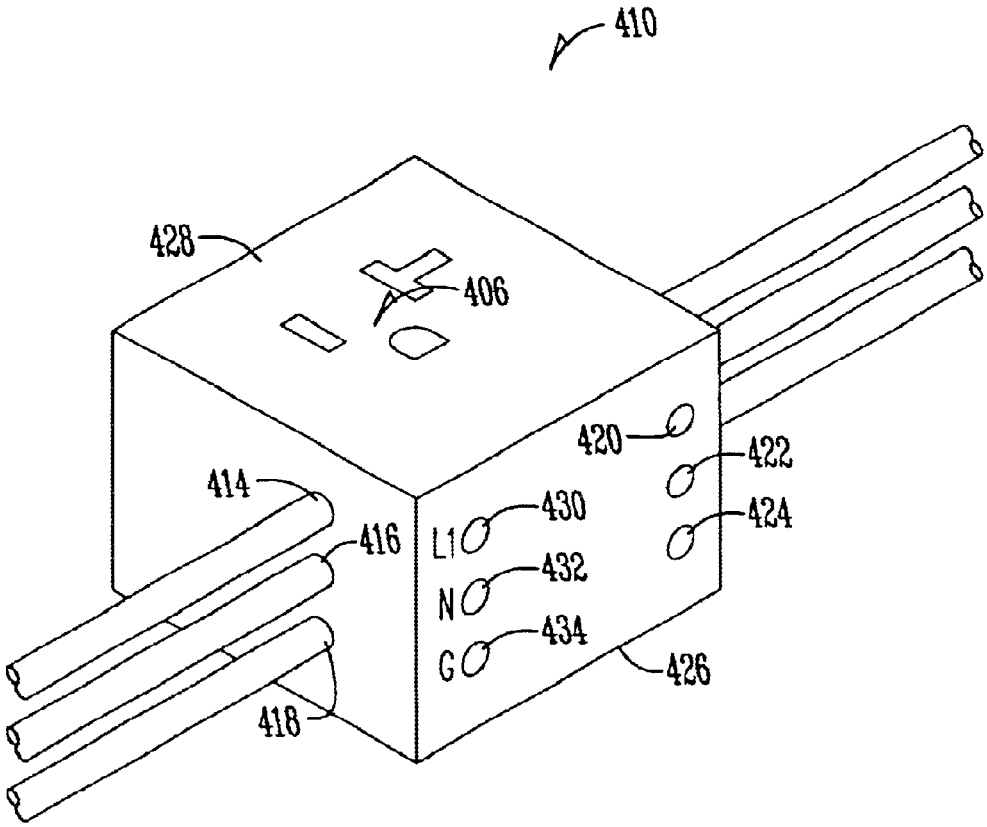
FIG. 11 is a perspective view of another embodiment of a non-GFCI device with incoming and outgoing leads.
Figure 12:
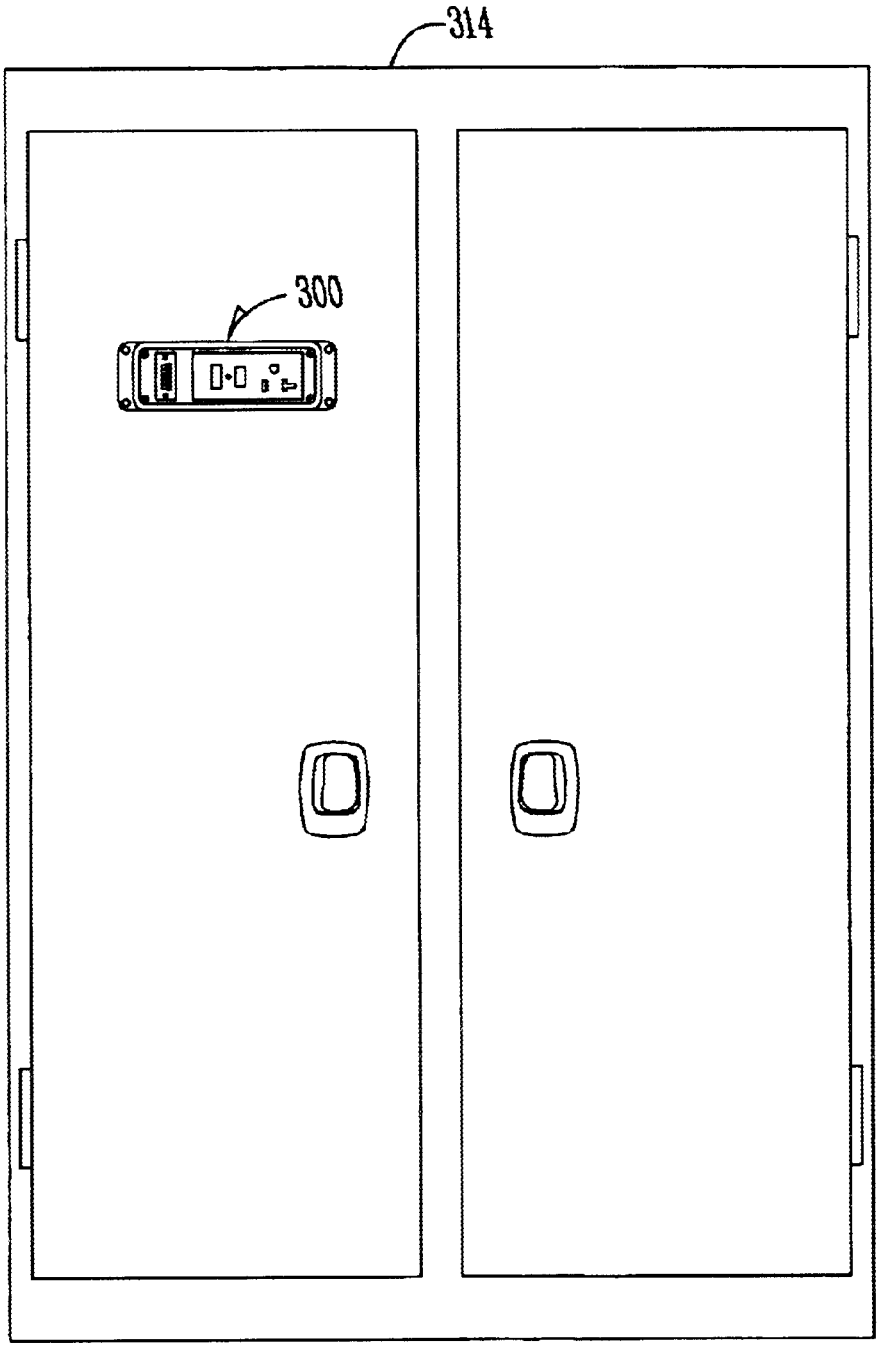
FIG. 12 is a perspective view of the device of FIG. 5 mounted to a cabinet enclosure.
Figure 13:
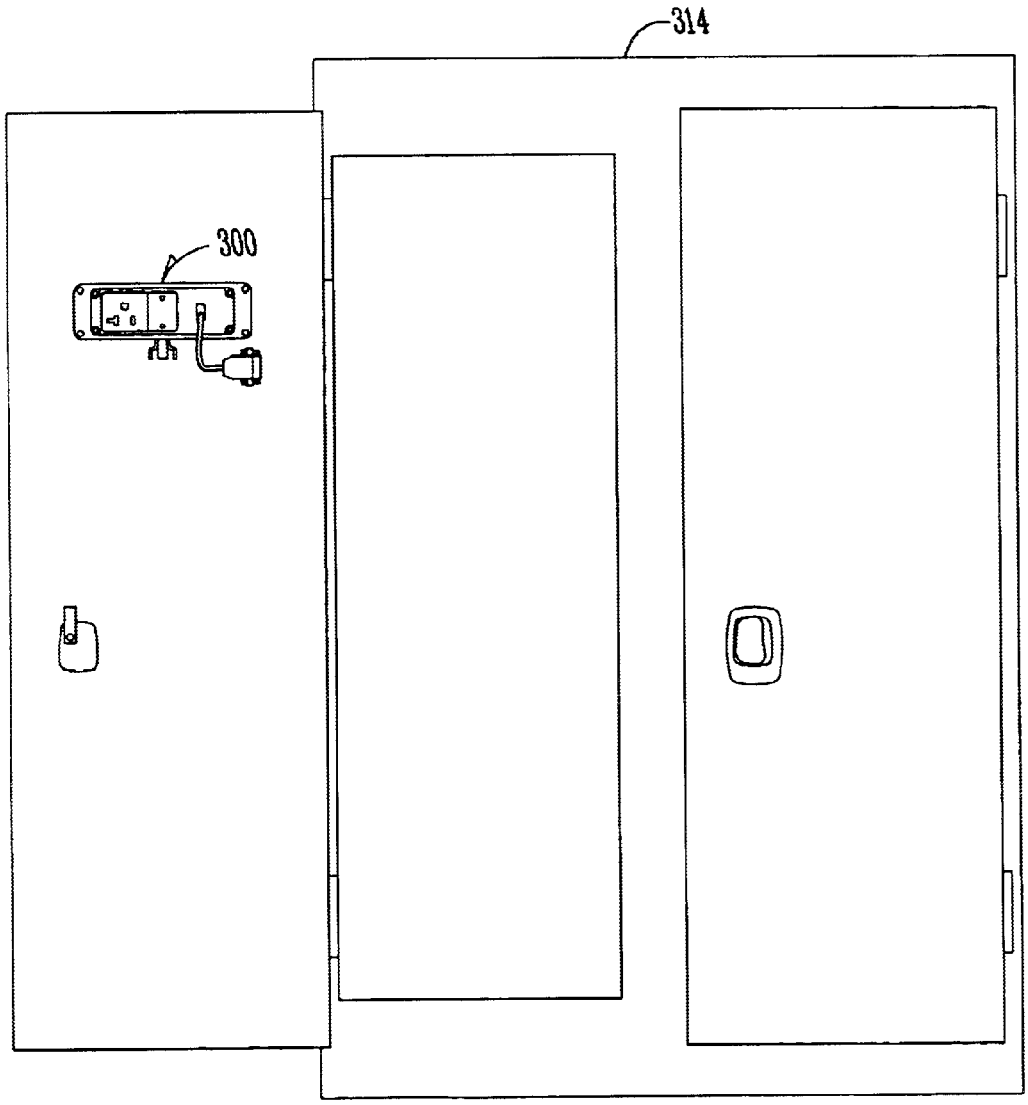
FIG. 13 is a perspective view of the device of FIG. 6 mounted to a cabinet enclosure.

FIG. 11 shows a perspective view of one embodiment of the present invention. In FIG. 11, the assembly 410 includes an outside outlet on outside face 428. An inside outlet (not shown) is disposed on the inside face 426. There are three incoming power lines 414, 416, 418 that can be connected with screws 430, 432, 434. In addition, there are three outgoing connections (420, 422, 424) that can be used to power other devices.

The present invention contemplates numerous variations that will be apparent to one skilled in the art having the benefit of this disclosure. For example, the inside electrical outlets, and various connectors need not be on the face opposite the front face but can be one on or more of the side faces of the device.

Thus, a device for providing access to at least one power connection within a disclosure has been disclosed. The present invention contemplates numerous variations and equivalents.

What is claimed is:

1. A convenience interface device for providing access to at least one power connection within an enclosure, comprising:

an assembly adapted to use with the enclosure and having a top, a bottom, a first side, an opposite second side, an inside face and an outside face opposite the inside face, the inside face for being disposed within the enclosure, the outside face for being outside of the enclosure;

an inside female plug receptacle on the inside face and accessible from inside the enclosure;

an outside female plug receptacle on the outside face and accessible from outside the enclosure; and a plurality of apertures in the first side for receiving power line connections.

2. The device of claim 1 further comprising a data interface connector mounted to the outside face for being outside of the enclosure.

3. The device of claim 2 wherein the data interface connector is a network connector.

4. The device of claim 2 wherein the data interface connector is a serial connector.

5. The device of claim 2 wherein the assembly is sized to fit within a 24 position Deutsches Institut fur Normung rectangular connector housing.

6. The device of claim 1 wherein the inside female plug receptacle is a Nema 5-15A outlet.

7. The device of claim 1 wherein the inside female plug receptacle is a Nema 5-20R outlet.

8. The device of claim 1 wherein the outside female plug receptacle is a Nema 5-15R outlet.

9. The device of claim 1 wherein the outside female plug receptacle is a Nema 5-20R outlet.

10. The device of claim 1 further comprising a ground fault interrupter circuit disposed within the assembly.

11. The device of claim 1 wherein the assembly is sized to fit within a standard 16 position Deutsches Institut fur Normung rectangular connector housing.

12. The device of claim 1 further comprising operatively connected to the assembly a plurality of apertures in the inside face for receiving screws to secure the power line connection.

13. The device of claim 12 further comprising finger safe screws.

14. The device of claim 1 further comprising a test push button on the second face.

15. The device of claim 1 further comprising a reset push button on the second face.

* * * * *